US007229040B2

(12) United States Patent
Juhlin

(10) Patent No.: US 7,229,040 B2
(45) Date of Patent: Jun. 12, 2007

(54) BOWL LINER RETAINING METHOD AND APPARATUS

(75) Inventor: Jon Juhlin, Pleasant Hill, OR (US)

(73) Assignee: Johnson Crushers International, Eugene, OR (US)

( * ) Notice: Subject to any disclaimer, the term of this patent is extended or adjusted under 35 U.S.C. 154(b) by 166 days.

(21) Appl. No.: 10/973,620

(22) Filed: Oct. 25, 2004

(65) Prior Publication Data

US 2006/0086852 A1 Apr. 27, 2006

(51) Int. Cl.
*B02C 2/00* (2006.01)

(52) U.S. Cl. ..... 241/207

(58) Field of Classification Search ..... 241/207–216, 241/37; 29/428
See application file for complete search history.

(56) References Cited

U.S. PATENT DOCUMENTS

| | | | | |
|---|---|---|---|---|
| 3,235,190 | A | 2/1966 | Simons | |
| 3,371,875 | A | 3/1968 | Gasparac et al. | |
| 3,437,277 | A * | 4/1969 | Szaj et al. | 241/207 |
| 3,539,120 | A | 11/1970 | Szaj et al. | |
| 4,478,373 | A | 10/1984 | Gieschen | |
| 4,892,257 | A * | 1/1990 | Stoeckmann et al. | 241/32 |
| 6,007,009 | A * | 12/1999 | Sheridan et al. | 241/207 |

* cited by examiner

*Primary Examiner*—Mark Rosenbaum
(74) *Attorney, Agent, or Firm*—Schwabe, Williamson & Wyatt, P.C.

(57) ABSTRACT

A bowl liner retaining device is provided that may allow for easy and quick replacement of worn or unusable bowl liners on cone crushers, while capable of providing a sufficient amount of tensioning load to hold the bowl liner in operational position during a rock-crushing operation.

28 Claims, 4 Drawing Sheets

BOWL LINER RETAINING METHOD AND APPARATUS

FIELD OF THE INVENTION

Embodiments of the present invention relate to gyratory cone crushers, and more particularly to a method and apparatus for retaining a bowl liner in a gyratory cone crusher.

BACKGROUND

Gyratory cone crushers are particularly well suited for crushing rock and other natural materials. Such crushers typically have a base frame that includes a cone-shaped crushing head, which may be generally referred to as a cone assembly, oriented upward and adapted for gyratory motion, and a bowl configured to encompass the cone crushing head, such that rock is crushed between the bowl and the cone crushing head. Because these surfaces take a significant amount of abuse, both the crushing head and the bowl can be fitted with replaceable liners, which are made of a material that is well suited to withstand the rigors of rock crushing.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

The following description includes terms such as inner, outer, under, between, upward, downward, outward, inward, and the like, which are used for descriptive purposes only and are not to be construed as limiting. That is, these terms are terms that are relative only to a point of reference and are not meant to be interpreted as limitations but are, instead, included in the following description to facilitate understanding of the various aspects of the invention.

Embodiments of the present invention may include a retaining mechanism for holding bowl liners in a bowl during operational and non-operational periods. Embodiments of the present invention may allow for reliable retention of bowl liners, with the ability to more quickly replace worn or broken bowl liners without significant time delays and also reducing the number and complexity of parts. A variety of cone crusher designs are known and currently used. One common feature among the designs is the use of a replaceable bowl liner. Accordingly, bowl liner retaining apparatuses in accordance with the present invention may be used with a variety of cone crusher designs, either an original equipment manufacturer product or an after-market or retrofit application with replacement bowl liners.

Figure 1:
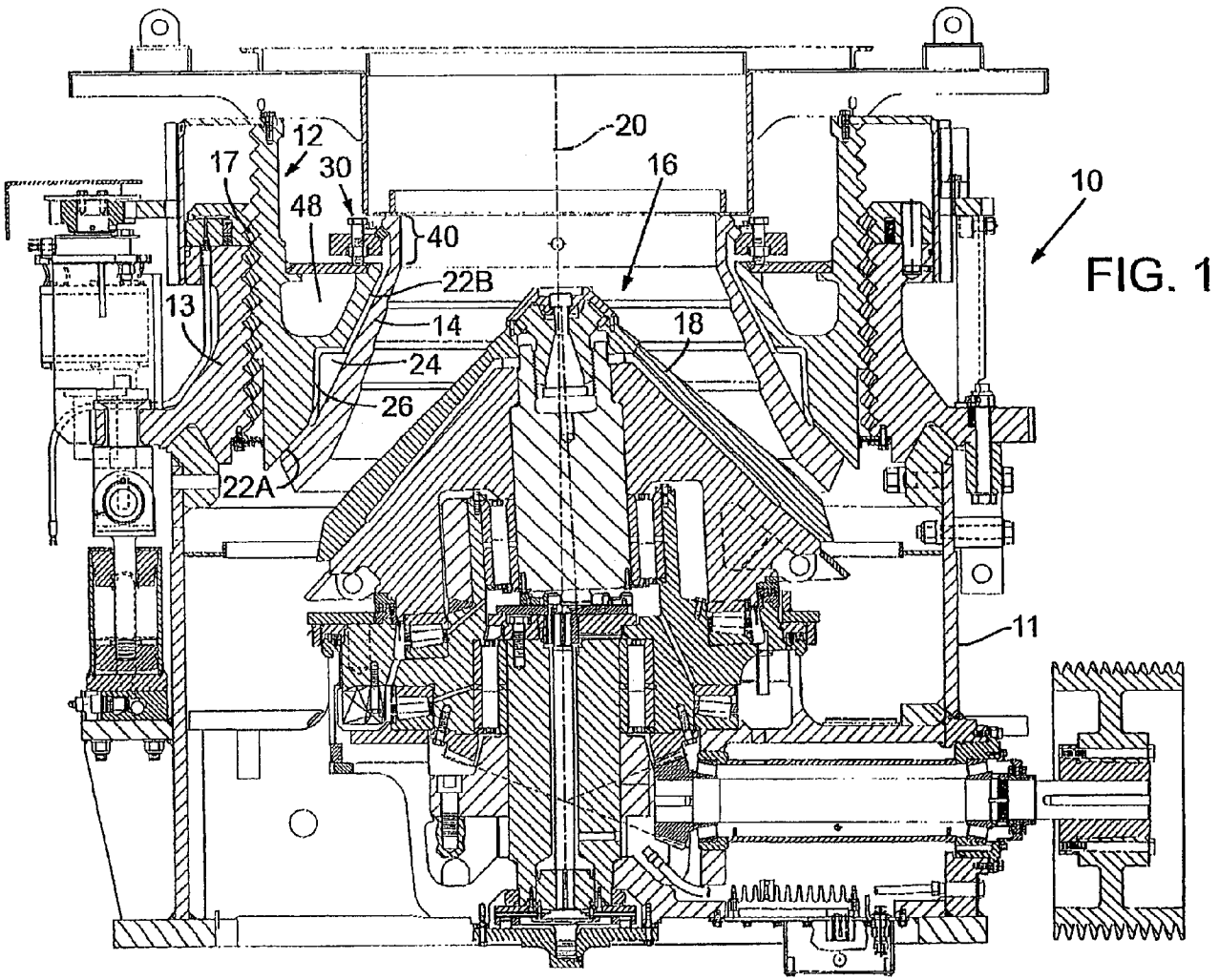
FIG. 1 illustrates a cross-sectional view of an example gyratory cone-type crusher in accordance with an embodiment of the present invention.

FIG. 1 illustrates a cross-sectional view of an example gyratory cone-type crusher 10 in accordance with an embodiment of the present invention. The crusher 10 may have a bowl 12, which may be disposed in an inverted position generally over a cone-shaped crushing head, or cone assembly 16 and centered on a vertical crusher axis 20. Cone assembly 16 may be operationally coupled to the base frame 11 of crusher 10 and have a removable mantle 18 secured thereto. Mantle 18 then can act as the interface surface for the rock or material being crushed. Cavity 48 may be present in bowl 12 to help reduce weight, but is not required.

Bowl 12 may be supported by bowl support 13 and serve to provide a mechanism for adjusting the closed side setting of the crusher, as well as provide structural support for a replaceable bowl liner 14, which then can act as the durable interface surface for the rock being crushed. Bowl support 13 may also sometimes be referred to as, for example, the "adjustment ring," "bowl nut," and the "upper frame." Bowl liner 14 may be known by other names, such as, but not limited to a "concave." In one embodiment of the present invention, the bowl support 13 and bowl 12 may include a threaded interface 17, such that the bowl 12 may be raised and lowered as desired to adjust the closed side setting.

The cone assembly 16 and mantle 18 may be movably mounted strategic to bowl 12 and bowl liner 14, such that rock may be crushed between the mantle 18 and the bowl liner 14 as the material flows through the cone crusher 10. The bowl liner 14 and mantel 18, then, are the sacrificial wear parts that help prolong the life of cone crusher 10. The bowl liner 14 and mantle 18 may thus be made of special materials particularly suited for compression crushing of rock and other materials. In one embodiment, a steel, richly alloyed with manganese, may be used as the base material for bowl liner 14 and mantle 18.

During operation of the cone crusher 10, the bowl liner 14 must be retained within bowl 12 in a manner such that it can withstand the oftentimes severe forces, impacts, and other abuse encountered during the crushing operation. The shape of the bowl liner 14, then, may generally mimic or be substantially similar to that of the conical shape of the inner portion of bowl 12. Accordingly, the bowl liner 14 may be configured to be in close engagement at points along the conical inner portion of the bowl, which may be generally illustrated by example points 22A and 22B. In some embodiments in accordance with the present invention, the bowl liner may be in direct contact with the conical portion of the bowl, as shown for example at 22A, or may be spaced apart from the bowl 12 a predetermined distance, as shown for example at 22B, or a combination thereof. Any space between the bowl liner 14 and bowl 12 may be filled with a material, such as an epoxy resin, which may provide sufficient support for the bowl liner during operation and to help resist bowl liner deformation.

Because cone assembly 16 gyrates and crushes material between the mantle 18 and stationary bowl liner 14, there is a tendency for the bowl liner 14 to want to rotate within the bowl 12. In one embodiment, ears or bosses 24 may be incorporated on the backside of the bowl liner 14 and configured to engage detents or slots 26 in the conical inner surface of bowl 12, such that rotation of the bowl liner 14 within bowl 12 may be resisted. One or more bosses 24 may be used to help prevent rotation of the bowl liner 14. In other embodiments in accordance with the present invention, bosses 24 may be formed in or separately secured to bowl liner 14. In another embodiment, the bosses may be secured to or formed as a part of the conical inner surface of bowl 12 and configured to engage corresponding detents/slots in the non-process side of bowl liner 14.

Bowl liner 14 may be retained within bowl 12 by bowl liner retaining apparatus 30, which may be adapted to exert an upward force on an upper portion 40 of bowl liner 14. This exertion of upward force on the bowl liner 14 may help keep the bowl liner 14 in an operational position, such that there is engagement between a portion of the non-operational surface of the bowl liner and a portion of the inner conical surface of the bowl. In one embodiment, the lower portion of bowl liner 14 is forced into engagement with the inner conical surface of bowl 12 at 22A, but a space is maintained between the bowl liner and the inner conical portion of bowl 12 at other areas, such as 22B.

Figure 2A:
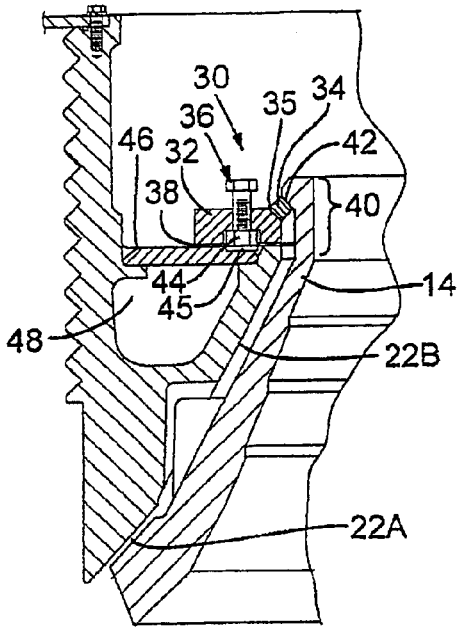
FIGS. 2A and 2B illustrate enlarged cross-sectional views of a bowl liner retaining device in accordance with an embodiment of the present invention.
Figure 2B:
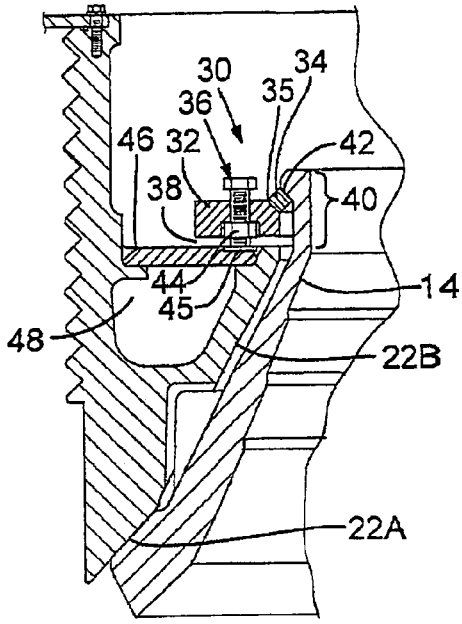

FIGS. 2A and 2B illustrate enlarged cross-sectional views of a bowl liner retaining apparatus in accordance with embodiments of the present invention. FIG. 2A illustrates the bowl liner 14 prior to actuation of the bowl liner retaining apparatus 30, whereas FIG. 2B illustrates the bowl liner 14 after actuation of bowl liner retaining apparatus 30.

In one embodiment, bowl liner retaining apparatus 30 may include a tension ring 32 that may have an inner diameter that is larger than the largest outer diameter of upper portion 40 of bowl liner 14. This may enable tension ring to be placed over the upper portion 40 of bowl liner 14 as a single unit without having to break the ring and alter its structural integrity. Tension ring 32 may be placed on a tension ring support 46, which may be any surface adapted to support the tension ring. In one embodiment, the tension ring support 46 may be a separate plate positioned in an accommodating recess in bowl 12 (as illustrated). In other embodiments, the tension ring support may be, for example, an integral portion of the bowl itself.

A retainer 34 may be disposed in a circumferential space created between a first retainer engaging surface 35 disposed about at least a portion of tension ring 32 and a second retainer engaging surface 42 disposed about at least a portion of the upper portion 40 of bowl liner 14 in order to allow an operational interface and a retaining of bowl liner 14 against the inner conical surface of bowl 12, at surface 22A. In one embodiment, retainer 34 may be an annular ring having an inner diameter that is smaller than the largest diameter of upper portion 40 of bowl liner 14, and sized to allow for operational interface between the first and second retainer engaging surfaces 35 and 42. In order to get retainer 34 around the upper portion 40 of bowl liner 14, retainer 34 may be split such that it can be temporarily enlarged to get around the upper portion 40 of bowl liner 14, and may be tempered such it will resume its original shape having a diameter less than the upper portion 40 of bowl liner 14.

The first and second retainer engaging surfaces 35 and 42 may be configured for operational engagement with retainer 34 in order to generate sufficient surface-to-surface contact that may help resist forces acting on the retainer 34. In one embodiment, the first and second retainer engaging surfaces may be slightly chamfered such that there is good surface area to surface area contact between the chamfered surfaces and the retainer 34.

In other embodiments, the first and second retainer engaging surfaces 35 and 42 may be grooved or otherwise formed to allow for coordinated mating of the first and second retainer engaging surfaces with the retainer. In some embodiments, the circumferential space can be configured to accommodate retainers of a variety of cross sections, for example, circular, rectangular, or cross sections having a complex geometry. Depending on the retainer cross section, first and second retainer engaging surfaces 35 and 42 may be configured to correspond to a portion of the retainer edge profile.

Figure 4:
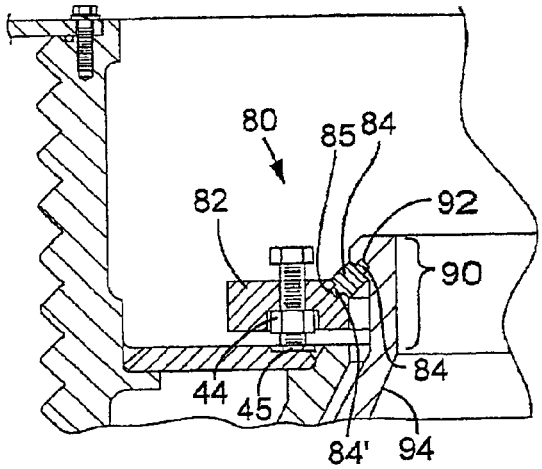
FIG. 4 illustrates an enlarged cross-sectional view of a bowl liner retaining device in accordance with an embodiment of the present invention.

FIG. 4 illustrates an enlarged view of an example bowl liner retaining apparatus 80 having a retainer 84 and first and second retainer engaging surface configuration in accordance with an embodiment of the present invention. Retainer 84 may have a generally square or rectangular cross section with first and second protrusions 84', 84". First retainer engaging surface 85 of tension ring 82 may include a groove sized to accommodate first protrusion 84' and second retainer engaging surface 92 of upper portion 90 of bowl liner 94 may include a groove that likewise is sized to accommodate second protrusion 84". The engagement of protrusions 84' and 84" into the corresponding grooves of the first and second retainer engaging surfaces 85 and 92 may allow for retainer 84 to resist the tendency to migrate outward, such that it is maintained within the circumferential space.

One or more tensioning devices 36, which as illustrated in FIGS. 2A and 2B may be one or more jackscrews, may operationally interface with tension ring 32 to lift tension ring 32 generally away from tension ring support surface 46, as shown by space 38 in FIG. 2B. As the tensioning device 36 engages tension ring 32, tension ring 32 may be forced away from tension ring support surface 46. This in turn may generate a force that urges the bowl liner 14 in an upward direction by virtue of the interface between the first retainer engaging surface 35, retainer 34, and second retainer engaging surface 42. By urging the bowl liner 14 in an upward direction, it may make contact at various points along the conical surface of the bowl 12 (e.g., 22A), thereby generating and maintaining the necessary tensioning load required for retaining the bowl liner 14 in bowl 12.

In one embodiment, the angle of the interface between first and second retainer engaging surfaces 35 and 42 and the retainer 34 may include a line of radial force at any point around the circumference of the retainer 34 and which may be directed to a point outside of the upper portion 40 of the bowl liner 14. The outward radial component of this force may be resisted by the tangential tensile stress created in the tension ring 32. The inward radial component may be resisted by the tangential compressive stress created by the upper portion 40 of the bowl liner 14. Accordingly, as the tension ring is lifted, the retainer 34 may be effectively clamped between the first and second retainer engaging surfaces 35 and 42, such that the vertical retaining load/tensional load may be resisted by shear stresses in the retainer 34, tension ring 32 and/or bowl liner 14.

Figure 5:
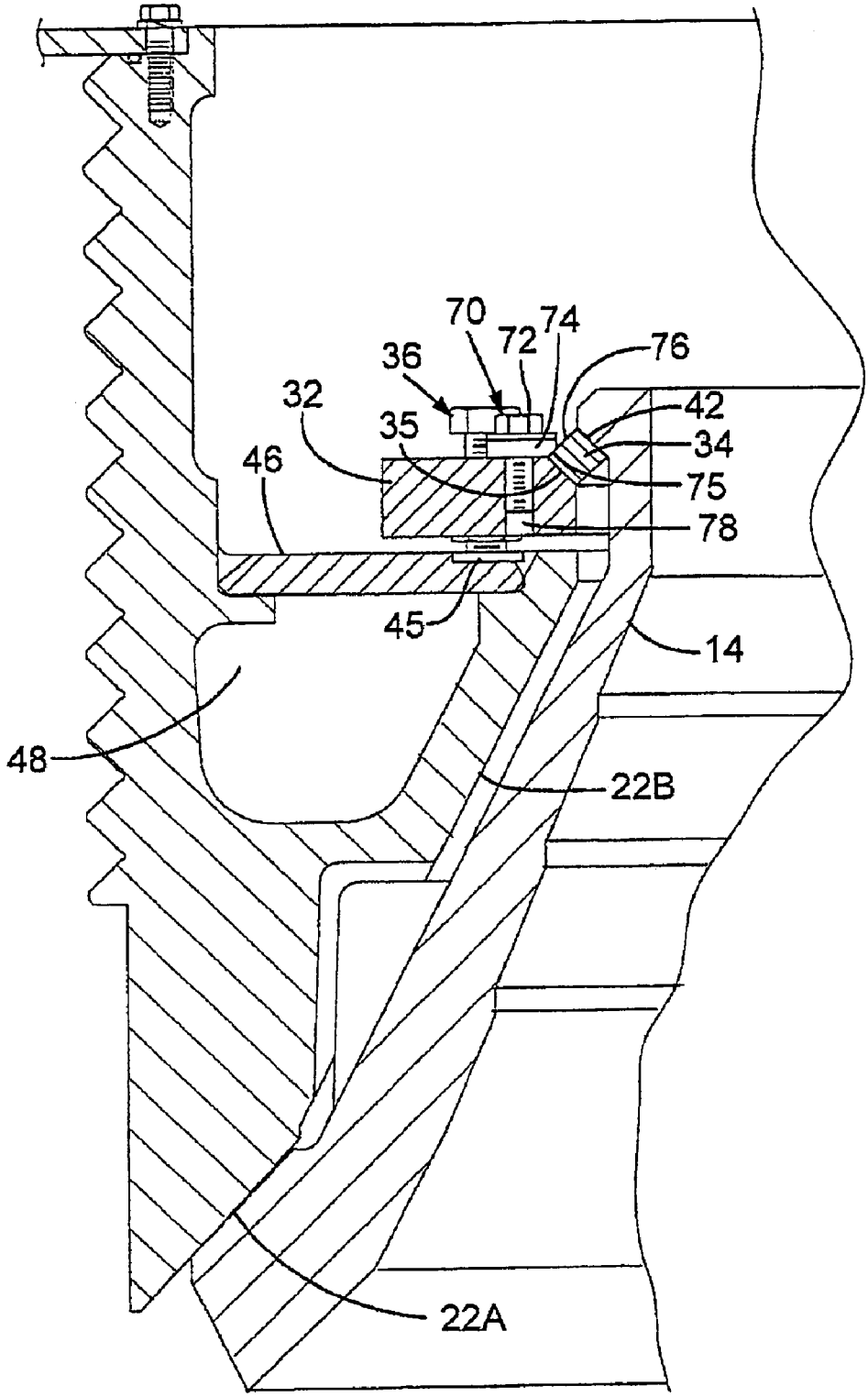
FIG. 5 illustrates an enlarged cross-sectional view of a bowl liner retaining device in accordance with an embodiment of the present invention.

In one embodiment, one or more clamp members may be securely disposed on the tension ring and configured to provide additional resistance to the potential outward migration tendency of the one or more retainers that may be caused by the outward radial component of the operational force. FIG. 5 illustrates a partial enlarged view of a bowl liner retaining apparatus in accordance with the present invention with a clamping member. Clamping member 70 may be adapted to couple to either or both tension ring 32 and retainer 34, and serve not only to help prevent outward migration of retainer 34, but also serve to align and hold retainer 34 in the circumferential space prior to actuation of the tensioning device (not shown).

In one embodiment, clamping member 70 may include a bolt 72 adapted to threadably engage bore 78 in tension ring 32. Bolt 72 may retain member 74, which can be adapted for engagement with retainer outside edge 76. Member 74 may be configured to have an edge 75 that may allow a close mating relationship with edge 76. Edge 75 may be, for example, a chamfered edge, grooved, or otherwise shaped to enhance mating. In other embodiments, member 74 may be of other configurations, such as, but not limited to, rings, washers, shrouds, and the like, and may be used to help resist the outward migration of retainer 34. Yet in other embodiments, a variety of fasteners may be used, rather than the bolt illustrated, to hold member 74 in place. Further, In other embodiments, the clamp member may be a single piece and/or may be permanently affixed to either the tension ring or the retainer.

Referring back to FIGS. 1-2, the amount of vertical tensioning load may be increased or decreased by, for example, tightening or loosening tensioning device 36 to increase or decrease the separation space 38 between tension ring support surface 46 and the tension ring 32. The magnitude of the vertical tensioning load may also be varied by increasing the number and position of the tensioning devices.

In one embodiment, where jackscrews are used as the tensioning device, a female threaded nut 44 may be disposed in an accommodating bore in tension ring 32, which may be sized to prevent rotation thereof. The threads of the nut and the jackscrew may be made of a higher strength material than that of the tension ring, which may help resist the stresses encountered by the threads when placing the tension ring under load. In other embodiments of the present invention, the bore in the tension ring may be tapped with threads for the jackscrew to engage, such that nut 38 is not necessary. In one embodiment, a depression 45 in support surface 46 may be engaged by the end of the jackscrew, which may help prevent rotation of the tension ring 32 as well as help proper alignment. In other embodiments, a hardened plate may be inserted into depression 45, and act as a resistive wear surface for the tensioning device.

Embodiments of the present invention contemplate the use of tensioning devices other than a jackscrew and nut configuration illustrated in FIGS. 2A and 2B. Other such tensioning devices may include, but are not limited to, radial and/or helical wedges, one or more hydraulic or pneumatically actuated pistons, springs, and the like. Further, additional components, such as a bracket, may be secured to the bowl and adapted for coupling or interlocking to the tension ring, such that where the tension ring is in non-rotational engagement with the bowl liner, the components, may help prevent the rotation of the bowl liner. Accordingly, in such embodiments, the bosses and recesses described above may not be required.

Figure 3A:
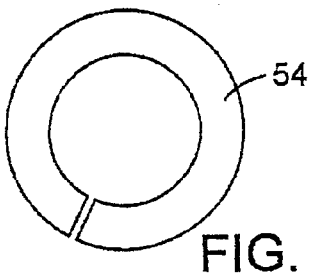
FIGS. 3A and 3B illustrate top views of retainers in accordance with embodiments of the present invention.
Figure 3B:
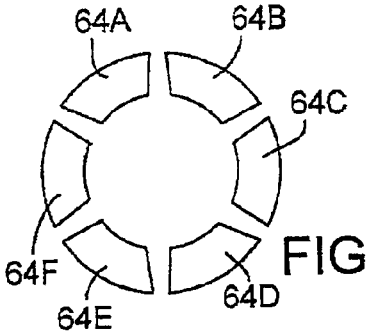

FIGS. 3A and 3B illustrate an enlarged plan view of example retainer configurations in accordance with an embodiment of the present invention. FIG. 3A illustrates an example retainer 54 that is a single ring having a rectangular cross section and is split such it may be expanded to allow the retainer to pass over the upper portion of the bowl liner. FIG. 3B illustrates another example of a retainer in accordance with embodiment of the present invention. A plurality of retainer segments 64A through 64F may be individually placed in the circumferential space between the first and second retainer engaging surfaces 35 and 42 of the tension ring 32 and upper portion 40 of the bowl liner 14. Embodiments of the present invention may include one or more retainer segments, and may be increased or decreased as desired to provide the desired tensioning around the circumference of the bowl liner 14.

Figure 6:
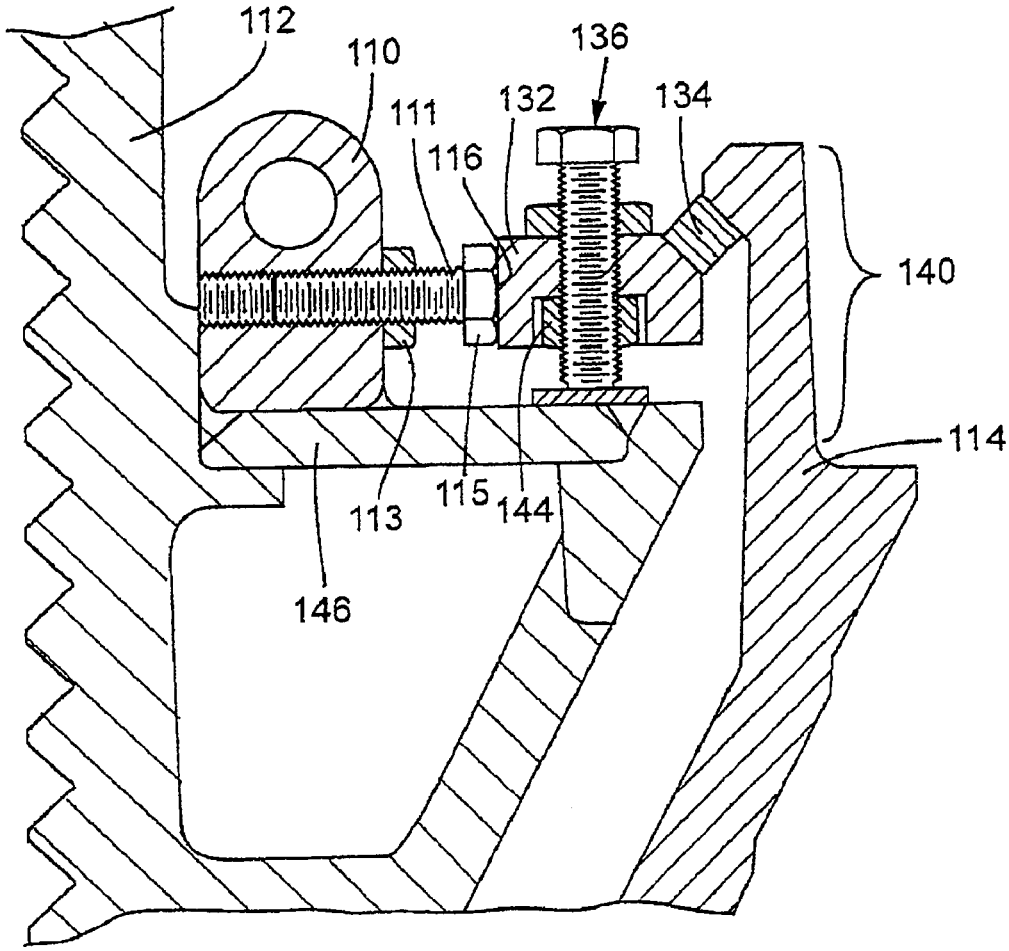
FIG. 6 illustrates an enlarged cross-sectional view of a bowl liner retaining device in accordance with an embodiment of the present invention.

Embodiments of the present invention may also include radial supports to help the tension ring resist radial movement due to the radial forces imparted through the bowl liner. This in turn may help enhance the effectiveness of the backing material to maintain the bowl liner in a secure operational configuration. In one embodiment of the present invention, illustrated in FIG. 6, one or more braces 110 may be secured to bowl 112 and/or tension ring support 146. A tensioning bolt 111 may be threadably disposed in brace 110 and adapted for engagement with tension ring 132 at the outer side 116. One or more tensioning devices, such as jackscrew 136 and nut 144 may be used to urge retainer 134 into engagement with the upper portion 140 of bowl liner 114.

Tensioning bolt 111 may be unscrewed such that the head 115 is in engagement with tension ring side 116, such that radial movement of the tension ring 132 is resisted. A lock nut 113 may be used to ensure that tensioning bolt 111 does not move due to the forces encountered during processing. Embodiments of the present invention may include a number of radial supports, including, but not limited to, wedges, hydraulic cylinders, and the like, which may resist radial movement of the tension ring. Further, it can be appreciated that one or more radial supports may be used around the perimeter of the tension ring to increase the resistance to radial movement.

The use of radial supports in accordance with embodiments of the present invention may not only serve to prevent radial movement of the bowl liner, but also serve to help transfer radial load generally resisted by backing material, if used, directly to the bowl itself. Providing such mechanical radial support may allow the backing material to focus on providing resistance to localized deflection of the bowl liner due to direct localized pressure resulting from crushing operations.

Embodiments of the present invention may allow for constant or periodic adjusting of the tension of the retaining device in order to ensure the bowl liner maintains a good interface with the bowl, which in turn may help prolong the life of the bowl liner. An automatic control system may be used to control the retaining device and adjust the tension load placed on bowl liner 14 as needed depending on, for example, the operation and amount of wear encountered by the bowl liner. In one embodiment, the control system may include a CPU/controller in electrical communication with a load detection device (e.g., a load cell) that may detect the tensional load or when additional tension must be applied to the bowl liner.

The controller may also be in communication with the load detection device and tensioning devices, such that it can automatically actuate the tensioning devices in order to increase or decrease the load as necessary. The controller may also be in communication with the tensioning device and the load detection device through the use of a wireless means, such as radio frequency, infrared, and the like. In such a case, the controller may be positioned remotely from the crusher, while still being able to receive signals from the load detection device and send (and receive) signals to the tensioning devices in order to control the tension applied to the bowl liner during operation.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

What is claimed is:

1. A bowl liner retaining apparatus, comprising:

a tension ring having a first retainer engaging surface;

one or more retainers configured to be disposed in a space that is created between the first retainer engaging surface and a second retainer engaging surface disposed on an upper portion of a bowl liner; and one or more tensioning devices operationally coupled to the tension ring and configured to move the tension ring and urge the bowl liner into operational engagement with a bowl.

2. The bowl liner retaining apparatus of claim 1, wherein the one or more tensioning devices includes one or more jackscrews configured to pass through a corresponding one or more holes in the tension ring such that turning the one or more jackscrews will move the tension ring.

3. The bowl liner retaining apparatus of claim 2, wherein a nut is non-rotatively disposed in each of the one or more holes and configured to threadably engage the one or more jackscrews.

4. The bowl liner retaining apparatus of claim 1, wherein the one or more tensioning devices include one or more hydraulically actuated pistons operationally coupled to the tension ring such that actuating the one or more hydraulic pistons will cause the tension ring to move and affect the operational engagement between the bowl liner and the bowl.

5. The bowl liner retaining apparatus of claim 1, wherein the one or more tensioning devices include one or more helical wedges operationally coupled to the tension ring and adapted to controllably move the tension ring and affect the operational engagement between the bowl liner and the bowl.

6. The bowl liner retaining apparatus of claim 1, wherein the one or more retainers is a single split ring having a diameter smaller than the largest diameter of the upper portion of the bowl liner and adapted to be positioned within the circumferential space.

7. The bowl liner retaining apparatus of claim 1, wherein the one or more retainers includes one or more individual segments configured to be disposed in the circumferential space.

8. The bowl liner retaining apparatus of claim 1, wherein the one or more retainers has a first surface configured to mate with the first retainer engaging surface and a second surface configured to mate with the second retainer engaging surface, such that there is sufficient surface-to-surface contact between the one or more retainers and the first and second retainer engaging surfaces to resist outward migration of the one or more retainers.

9. The bowl liner retaining apparatus of claim 8, wherein the first and second retainer engaging surfaces are chamfered edges.

10. The bowl liner retaining apparatus of claim 1, further comprising one or more clamping members disposed on the tension ring and configured to resist outward migration of the one or more retainers from the circumferential space.

11. The bowl liner retaining apparatus of claim 1, further comprising one or more radial supports disposed between the bowl and an outer edge of the tension ring and configured to controllably provide support to the tension ring to resist radial movement of the tension ring and bowl liner.

12. The bowl liner retaining apparatus of claim 11, wherein the one or more radial supports includes a radially adjustable member selected from a group including a bolt, hydraulic cylinder, pneumatic cylinder, a radial wedge, and a helical wedge.

13. The bowl liner retaining apparatus of claim 1, further comprising one or more rotational supports configured to secure the tension ring to the bowl such that the tension ring will resist rotational movement.

14. A cone crusher, comprising:

a crusher head;

a bowl positioned for operational engagement with the crusher head, the bowl including an upper opening for receiving material to be crushed, an inner conical surface, and a tension ring support;

a bowl liner having a processing side adapted for engagement with the material to be crushed and a non-processing side, the bowl liner having an upper portion having a first diameter and a second diameter, wherein the first diameter is smaller than the second diameter; and a bowl liner retaining apparatus comprising a tension ring, the tension ring having an inner diameter larger than the second diameter of the bowl liner, and a first retainer engaging surface;

one or more retainers configured to be disposed in a pace created between the first retainer engaging surface and an opposing second retainer engaging surface on the upper portion of the bowl liner; and one or more tensioning devices operationally coupled to the tension ring and configured to move the tension ring and urge the bowl liner into operational engagement with the bowl.

15. The cone crusher of claim 14, wherein the one or more tensioning devices is selected from a group consisting of jackscrews, helical wedges, radial wedges, hydraulically actuated pistons, gas-actuated pistons, and springs.

16. The cone crusher of claim 14, further comprising one or more clamp members disposed on the tension ring and configured to resist outward migration of the one or more retainers from the circumferential space.

17. The cone crusher of claim 16, wherein the one or more clamp members includes a washer bolted to the tension ring, the washer having a chamfered edge adapted to mate against an outer edge of the retainer.

18. The cone crusher of claim 14, wherein the bowl liner has one or more bosses disposed on the non-processing side, the bosses configured to engage corresponding detents disposed in the conical surface of the bowl to resist rotational movement of the bowl liner.

19. The cone crusher of claim 14, wherein one or more bosses are disposed about the conical surface of the bowl, the bosses configured to engage corresponding detents disposed in the non-processing side of the bowl liner to resist rotational movement of the bowl liner.

20. The cone crusher of claim 14, wherein the one or more retainers has a first surface configured to mate with the first retainer engaging surface and a second surface configured to mate with the second retainer engaging surface, such that there is sufficient surface-to-surface contact between the one or more retainers and the first and second retainer engaging surfaces to resist outward migration of the one or more retainers.

21. The cone crusher of claim 20, wherein the first and second retainer engaging surfaces are chamfered edges.

22. The cone crusher of claim 21, wherein the first and second chamfered edges include one or more grooves sized to accommodate a corresponding one or more protrusions on the retainer.

23. The cone crusher of claim 14, further comprising a control system adapted to automatically control the one or more tensioning devices to increase or decrease the amount of tensional load applied to the bowl liner.

24. The cone crusher of claim 23, wherein the control system includes a load detection device adapted to detect the tensional load on the bowl liner and a controller adapted to receive input signals from the load detection device, the controller also in communication with the one or more tensioning devices.

25. The cone crusher of claim 24, wherein the controller is in wireless communication with the load detection device and the one or more tensioning devices.

26. The cone crusher of claim 14, further comprising one or more radial supports disposed between the bowl and an outer edge of the tension ring and configured to controllably provide support to the tension ring to resist radial movement of the tension ring and bowl liner.

27. The cone crusher of claim 26, wherein the one or more radial supports includes a radially adjustable member selected from a group including a bolt, hydraulic cylinder, pneumatic cylinder, a radial wedge, and a helical wedge.

28. The cone crusher of claim 14, further comprising one or more rotational supports configured to secure the tension ring to the bowl such that the tension ring will resist rotational movement.

* * * * *

UNITED STATES PATENT AND TRADEMARK OFFICE

CERTIFICATE OF CORRECTION

PATENT NO. : 7,229,040 B2
APPLICATION NO. : 10/973620
DATED : June 12, 2007
INVENTOR(S) : Jon Juhlin It is certified that error appears in the above-identified patent and that said Letters Patent is hereby corrected as shown below:

Figure 4
Reference number 84 above reference number 94 should be --reference number 84--.

Column 8
Line 51, "...in a pace..." should read --...in a space...--.

Signed and Sealed this

Twenty-third Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,229,040 B2
APPLICATION NO. : 10/973620
DATED : June 12, 2007
INVENTOR(S) : Jon Juhlin It is certified that error appears in the above-identified patent and that said Letters Patent is hereby corrected as shown below:

Drawing
Figure 4
Reference number 84 above reference number 94, should be reference number 84.

Column 8
Line 51 claim 19, "...in a pace…" should read --...in a space…--.

Signed and Sealed this

Seventh Day of October, 2008

JON W. DUDAS
*Director of the United States Patent and Trademark Office*